United States Patent [19]

Abdallah

[11] 4,128,980

[45] Dec. 12, 1978

[54] REINFORCED CONCRETE CONSTRUCTION

[75] Inventor: Nessib Abdallah, Forestville, Australia

[73] Assignee: Civil & Civic Pty. Limited, Sidney, Australia

[21] Appl. No.: 804,276

[22] Filed: Jun. 7, 1977

[30] Foreign Application Priority Data

Jun. 11, 1976 [AU] Australia ..... 6236/76

[51] Int. Cl.[2] ..... E04B 1/20

[52] U.S. Cl. ..... 52/251; 52/259; 52/263; 52/283; 52/285

[58] Field of Search ..... 52/690–693, 52/326, 328, 329, 331, 646, 648, 650–653, 432, 583, 587, 721, 723, 251, 252, 259, 260, 262, 283, 285, 287, 263

[56] References Cited

U.S. PATENT DOCUMENTS

| | | | |
|---|---|---|---|
| 1,060,853 | 5/1913 | Peirce | 52/432 |
| 1,662,752 | 3/1928 | Lucy | 52/691 |
| 1,791,278 | 2/1931 | Lucy | 52/692 |
| 1,911,018 | 5/1933 | Goeltz | 52/648 |

FOREIGN PATENT DOCUMENTS

| | | | |
|---|---|---|---|
| 143698 | 6/1920 | United Kingdom | 52/583 |
| 604122 | 6/1948 | United Kingdom | 52/648 |

*Primary Examiner*—James L. Ridgill, Jr.
*Attorney, Agent, or Firm*—Haseltine, Lake & Waters

[57] ABSTRACT

A partially trussed device for encasement in a concrete member is disclosed which permits transfer of shear forces. The partially trussed device preferably takes the form of two spaced parallel steel rods interconnected by steel truss members so as to form a plurality of triangular panels. If desired one or both of the rods may be incorporated into or formed integrally with the steel reinforcing of a concrete beam or column.

9 Claims, 8 Drawing Figures

REINFORCED CONCRETE CONSTRUCTION

This invention relates generally to the field of reinforced concrete construction and more particularly to the provision of a shear transfer connection between a previously fabricated structural member and a subsequent structural member where the connection between the members is in accordance with reinforced concrete practice.

In structures using steel and concrete in composite manner construction involves a number of jointing situations where it is advantageous to fabricate a member at one stage and to connect a further member at a later stage. In such situations it is frequently necessary to transfer forces such as moments or shear across the joint.

The state of the art is such that the transfer of moments is satisfactorily resolved.

However, transfer of shear across a joint is, conventionally, a difficult problem to resolve. Solutions to this problem to date have resulted in cumbersome and expensive joint details such as corbels or large and heavy structural steel devices requiring subsequent connection by welding, stressing, bolting or pinning. In cases where members are precast, further complication and cost of such joint details are associated with the need to provide adequate tolerances to cater for misalignment due to the accumulation of dimensional errors which occur in the series of operations concerned viz:- fabrication of the jointing and connection devices, location of such devices in the casting mould, movement of the devices relative to the mould during casting operations, impacts due to handling of the completed members and finally misalignment during the final assembly positioning operation prior to connection.

Conventional resolution of shear transfer difficulties referred to above has involved payment of a premium in the complication of, or the physical size and shape of the members required in the area of the joint. This premium frequently forces designers to abandon pursuit of construction advantages previously sought.

It is an object of this invention to ameliorate disadvantages on conventional solutions to shear transfer problems at joint connections in reinforced concrete constructions. This object is achieved, in accordance with this invention, by virtue of a simple and economic means or shear transfer which, in its turn, provides the opportunity to pursue innovative solutions for concrete construction which fully exploit the benefits of prefabricated members according to the most advantageous construction sequence for the project concerned.

Accordingly, this invention discloses a partially trussed device for encasement in concrete comprising a pair of spaced rods and a plurality of truss members interconnecting said rods so as to form a rigid partially trussed framework having at least two triangular panels, each said rod having a part thereof forming at least one panel side, and said rods having sufficient extension beyond one of said panels to provide adequate anchorage in concrete. It is preferred that the rods be co-planar and further preferred that the rods be parallel.

In addition there is disclosed a member adapted for incorporation in a concrete construction, said member including a rigid extension for inclusion within a portion of said concrete construction abutting said member, said extension transferring shear and associated forces to said concrete construction and comprising at least part of the panels of the abovementioned partially trussed device for encasement in concrete.

Further the present invention discloses a concrete structure incorporating one or more of the above described members.

It will be clear to the man skilled in the art that the partially trussed device provided in accordance with this invention may be incorporated either integrally or independently into a steel, concrete or reinforced concrete member to become a rigid extension of the member capable of transferring shear and associated forces to a further member, allowing a rigid connection to be obtained between the members by the pouring of concrete around the partially trussed device, at least in the space of the joint between the members.

Structural members to which this invention may be applied may be either supported or supporting members with the partially trussed device initially incorporated into either a supported or supporting member. Such members may be fabricated using steel or concrete or in any combination of both, and can be fully or partially prefabricated or fabricated in situ, whichever requirement is dictated by expediency of construction. By way of example only, certain preferred forms of apparatus according to this invention are depicted in the accompanying drawings, in which.

Figure 1:
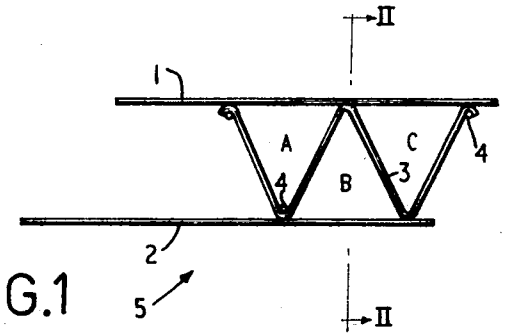
FIG. 1 is a side elevation of a partially trussed device in a general form.

The partially trussed device 5 of the preferred embodiment is illustrated in FIG. 1 and comprises an upper rod 1 and lower rod 2 which are spaced apart from each other. The upper rod 1 and lower rod 2 are interconnected by means of a zig-zag truss member 3 which together with the rods 1 and 2 forms three triangular panels A, B and C.

The upper and lower rods 1 and 2 extend sufficiently to provide adequate anchorage in concrete to be poured around the partially trussed device 5, as required. If desired pins 4 may be added to the panel points so as to increase the interengagement between the partially trussed device 5 and the concrete and thereby increase the bearing capacity of the concrete where required. The rods 1 and 2, the truss member 3 and pins 4 are preferably made from steel and the interconnections between these elements preferably take the form of welds.

In the preferred form of truss device 5 the rods 1 and 2 are co-planar and parallel. However, it should be understood that the rods 1 and 2 may be either co-planar and not parallel or alternatively, for example, may lie in parallel planes but not be parallel to each other.

Figure 2:
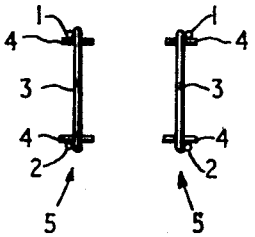
FIG. 2 is a cross-section taken along the line II—II of FIG. 1.

As seen in FIG. 2 the preferred form of the invention uses two spaced substantially parallel partially trussed devices 5 in order to enable increased shear forces to be transferred. However, if desired or expedient, the shear forces can be transferred by one partially trussed device 5 or could be distributed over many such devices.

Figure 3:
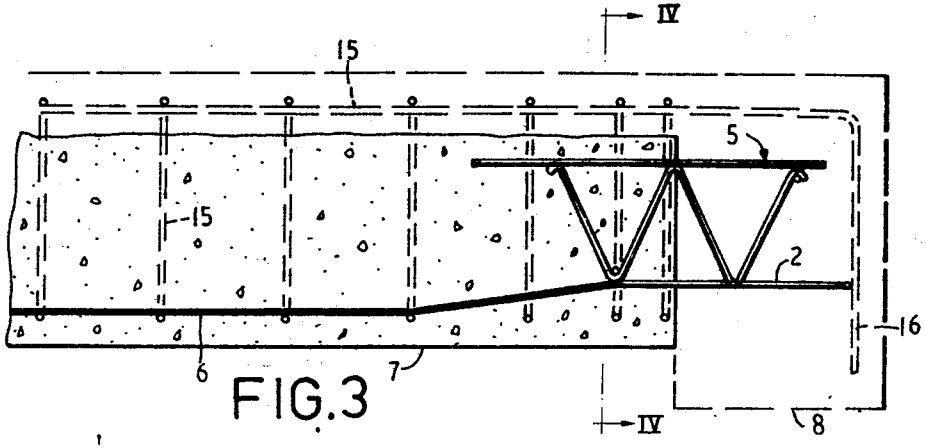
FIG. 3 is a longitudinal sectional elevation of a supported and supporting member in which the partially trussed device of FIG. 1 is incorporated in the supported member's reinforcement.
Figure 4:
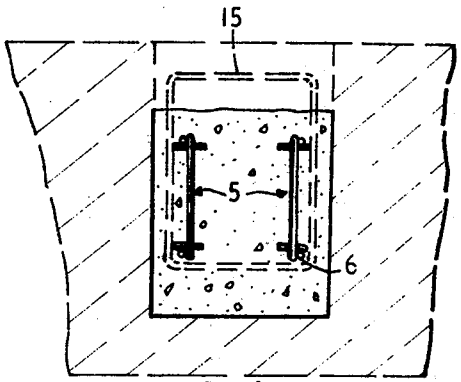
FIG. 4 is a cross-section taken along the line IV—IV of FIG. 3.

FIGS. 3 and 4 illustrate a supported structural member 7 including two partially trussed devices 5 in which the lower rod 2 is incorporated directly into a reinforcing rod 6 of the structural member 7. The remainder of the reinforcement of the supported structural member 7 is indicated by dashed lines in the drawings and comprises an open tubular mesh cage of substantially rectangular transverse cross-section formed from a plurality of reinforcing rods 15. In the embodiment illustrated in FIGS. 3 and 4, the supported structural member 7 is a prefabricated structural member whilst the supporting structural member 8 is subsequently fabricated in situ. In this particular case a portion of the reinforcing rods 15 and, in particular, the L-shaped extension 16 are not encased in concrete at the time the supported structural member 7 is fabricated. Thus, during fabrication of the supporting structural member 8, the free end of the partially trussed device 5, the L-shaped extension 16 and part of the reinforcing rods 15 and encased in the concrete poured at the time of fabricating the supporting structural member 8.

Figure 6:
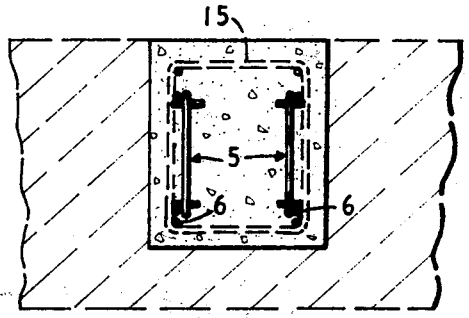
FIG. 6 is a cross-section taken along the line VI—VI of FIG. 5.
Figure 5:
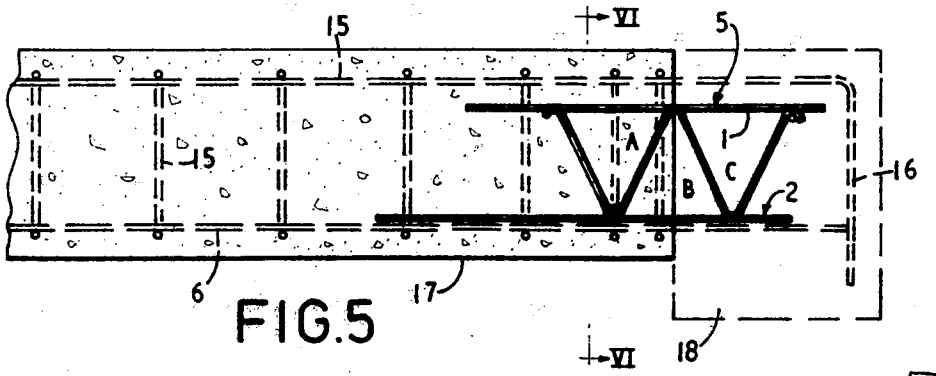
FIG. 5 is a longitudinal sectional elevation of a supported and supporting member in which the partially trussed device of FIG. 1 is independent from the supported element's reinforcement.

In the embodiment illustrated in FIGS. 5 and 6, a prefabricated supported structural member 17 is supported by a subsequently fabricated supporting structural member 18. In this embodiment, however, the partially trussed devices 5 are not integrally formed with reinforcing rods 6 but rather are separately formed. In this embodiment the lower rod 2 of each partially trussed device 5 is preferably tied with wire to the reinforcing rods 6. Also in this embodiment all the reinforcing rods 15 are encased in the concrete forming the supported structural member 17 leaving only the L-shaped extension 16 to be encased together with the free ends of the partially trussed devices 5 in the concrete forming the supporting structural member 18.

As was the case in the embodiment illustrated above in FIGS. 3 and 4, all of triangular panel C and one half of triangular panel B of each partially trussed device 5 is encased in the concrete forming the supporting structural member. In consequence half the triangular panels of each partially trussed device 5 are encased in the concrete of one member whilst the other half of the triangular panels is encased in the concrete of the other member. In this way excellent transfer of shear forces from the supported structural member 17 to the supporting structural member 18 is achieved.

Figure 7:
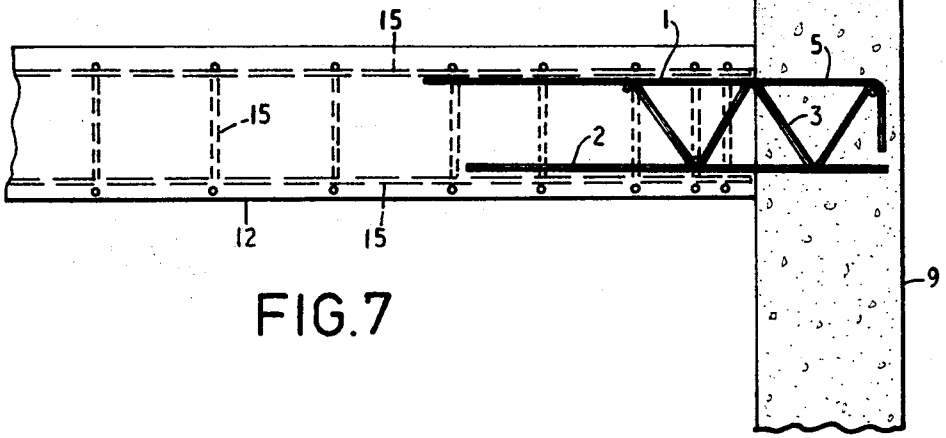
FIG. 7 is a longitudinal sectional elevation of a supported member and a prefabricated supporting member.

In the embodiment illustrated in FIG. 7, a prefabricated supporting structural member 9 is provided with a partially trussed device 5 located therein during its fabrication. The upper rod 1 and lower rod 2 and a portion of the truss member 3 extend from the supporting structural member 9 with the remainder of the partially trussed device 5 being embedded therein.

The reinforcing rods 15 of the supported structural member are formed and tied in situ with the upper rod and lower rod 2 being tied to the tubular open mesh cage of substantially rectangular transverse cross-section formed from the reinforcing rods 15. Then the concrete required to embed the supporting rods 15, and unencased portion of the partially trussed device 5 is poured thereby forming the supported structural member 12 in situ.

Figure 8:
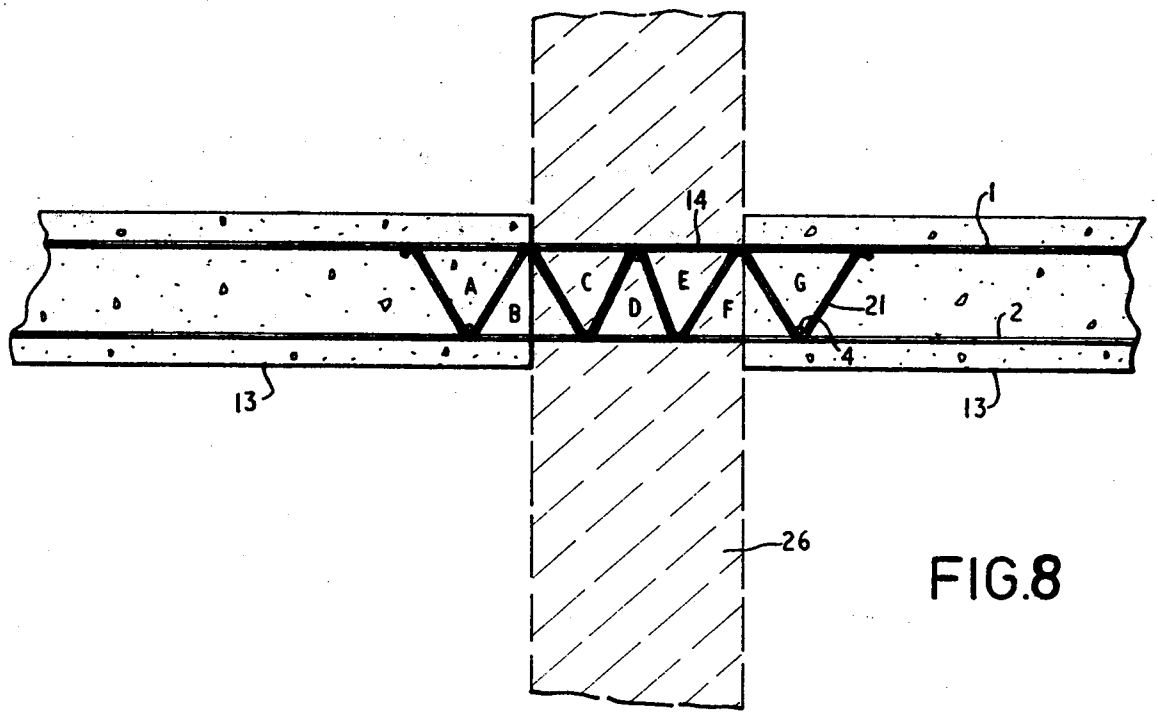
FIG. 8 is a longitudinal sectional elevation of two supported members and a single supporting member.

In the further embodiment illustrated in FIG. 8, two previously fabricated supported structural members or beams 13 are supported by a supporting structural member 26 which is formed in situ. A single partially trussed device 14 is provided for both beams 13 and includes a zig-zag truss member 21 which together with upper and lower rods 1 and 2 forms seven triangular panels A to G inclusive. As indicated the upper rod 1 and lower rod 2 are integrally formed with the reinforcing elements (not shown) positioned within the reinforced concrete beams 13. Triangular panels A and G and part of triangular panels B and F are included within the beams 13 whilst the remainder of the latter two panels and panels C, D and E are located within the supporting structural member 26.

Shear transfer across the concrete construction illustrated in FIG. 8 flows from the beams 13 to the supporting structural member 26. As will be seen by those skilled in the art, such a shear transfer has been achieved with a minimum of jointing details and jointing devices and substantially overcomes the problem of misalignment. The incorporation of the structural members illustrated above into a building or other structure formed substantially from reinforced concrete will be clear to those skilled in the art.

The foregoing describes only some embodiments of the present invention and modifications, obvious to those skilled in the art, may be made thereto without departing from the scope of the invention.

What I claim is:

1. A reinforced concrete member in a concrete construction, said concrete member extending horizontally in said construction and including: metal reinforcing means extending along substantially the length thereof an elongated partially trussed device with one end embedded in one end of said concrete member and encased in the concrete of said member; the other end of said device extending substantially horizontally from said concrete member for inclusion within a substantially vertical portion of concrete construction, said horizontal concrete member abutting said vertical portion abut said concrete member at a vertical surface at the time of casting said portion from concrete, said portion extending horizontally immediately only above said member; said device comprising a pair of spaced rods and a zig-zag truss member with welds interconnecting said rods so as to form a rigid partially trussed framework having at least two triangular panels, each rod having a part thereof forming at least one device side; said rods having sufficient extension beyond one of said panels to provide adequate anchorage in the concrete of said concrete member; said device transferring shear and associated forces from the concrete of said concrete member to vertically abutting concrete of said portion of the concrete construction.

2. A concrete member as claimed in claim 1 including a concrete structure with at least one of said concrete member.

3. The concrete member as claimed in claim 1 wherein said rods and truss members are substantially co-planar.

4. The concrete member as claimed in claim 1 wherein said rods and said truss members are formed from steel.

5. The concrete member as claimed in claim 3 wherein said rods are substantially parallel.

6. The concrete member as claimed in claim 5 wherein said truss members are integrally formed from a single zig-zag shaped member.

7. A concrete member as claimed in claim 1 wherein said portion of the concrete construction comprises a vertical column and said concrete member comprises a beam, said one end of said concrete member comprising one end of said beam abutting a vertical side of said column, said one beam end having one end of each of two of partially trussed devices embedded therein, the other ends of said devices extending into said column, said devices being transversely spaced with at least one of said panels of each said device being positioned within said beam and at least another one of said panels of each said device being positioned within said column.

8. A concrete member as claimed in claim 7 wherein the rods and truss members of each said device are formed from steel and are substantially co-planar, the rods of each said device being substantially parallel, the truss members of each said device being integrally formed from a single zig-zag shaped member.

9. A concrete member as claimed in claim 8 wherein part of each said device is integrally formed with the metal reinforcing means of said concrete member.

* * * * *